US006828293B1

(12) United States Patent
Hazenkamp et al.

(10) Patent No.: US 6,828,293 B1
(45) Date of Patent: Dec. 7, 2004

(54) WATER-SOLUBLE GRANULES OF SALEN-TYPE MANGANESE COMPLEXES

(75) Inventors: Menno Hazenkamp, Riehen (CH); Frank Bachmann, Freiburg (DE); Cornelia Makowka, Laufenburg (DE); Petr Kvita, Reinach (CH); Rolf Kuratli, Basel (CH); Anita Schmidlin, Sisseln (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 50 days.

(21) Appl. No.: 10/048,045

(22) PCT Filed: Jul. 20, 2000

(86) PCT No.: PCT/EP00/06934

§ 371 (c)(1),
(2), (4) Date: Jan. 24, 2002

(87) PCT Pub. No.: WO01/09276

PCT Pub. Date: Feb. 8, 2001

(30) Foreign Application Priority Data

Jul. 28, 1999 (EP) ..... 99810684

(51) Int. Cl.[7] ..... C11D 3/26; C11D 3/39; C11D 3/395; C11D 3/37

(52) U.S. Cl. ..... 510/376; 510/309; 510/311; 510/499; 502/200; 502/324

(58) Field of Search ..... 510/376, 378, 510/309, 311, 499; 502/200, 324

(56) References Cited

U.S. PATENT DOCUMENTS

| | | | | |
|---|---|---|---|---|
| 5,733,341 A | * | 3/1998 | Eckhardt et al. | 8/111 |
| 5,876,755 A | | 3/1999 | Perring et al. | 424/489 |
| 5,965,506 A | * | 10/1999 | Bacher et al. | 510/311 |

FOREIGN PATENT DOCUMENTS

| | | |
|---|---|---|
| EP | 630964 | 12/1994 |
| EP | 717103 | 6/1996 |
| EP | 902083 | 3/1999 |
| GB | 2309976 | 8/1997 |
| WO | 96/37593 | 11/1996 |
| WO | 97/16521 | 5/1997 |

* cited by examiner

*Primary Examiner*—Gregory R. Del Cotto
(74) *Attorney, Agent, or Firm*—Kevin T. Mansfield

(57) ABSTRACT

Water-soluble granules of salen-type manganese complexes that are suitable as catalysts in reactions with peroxy compounds are described. The granules are used especially in washing agents. They are distinguished by retarded dissolution and improved action of the manganses complexes.

14 Claims, No Drawings

WATER-SOLUBLE GRANULES OF SALEN-TYPE MANGANESE COMPLEXES

The present invention relates to water-soluble granules of salen-type manganese complexes, to a process for the preparation thereof and to the use thereof as dye-transfer inhibitors in washing agent preparations.

A number of salen-type manganese complexes are already known to be suitable catalysts for oxidations with peroxy compounds, especially within the context of washing procedures. The use of certain manganese complexes as catalysts for preventing the redeposition of migrating dyes in peroxide-containing washing liquors is described in EP 902 083, but the action of those manganese complexes as dye-transfer inhibitors is not optimum under all washing conditions. A further problem is that the peroxy compound and/or the catalyst in the washing agent formulation decompose(s) during prolonged storage in a moist atmosphere.

Surprisingly, it has now been found that granules comprising a salen-type manganese complex and at least 10% by weight of an anionic or non-ionic dissolution restrainer provide better inhibition of the redeposition of migrating dyes in washing liquors than is provided by the pure manganese complexes when the total amount of manganese complex entering into the washing liquor is the same in both cases. A further advantage of the granules is that the storage stability of peroxide-containing washing agent formulations comprising such granules is improved. In addition, these granules inhibit undesired colouration of the washing agent as a result of the gradual dissolution of the manganese complexes in one or more of the washing agent components.

The present invention accordingly relates to water-soluble granules of salen-type manganese complexes, comprising a) from 1 to 89% by weight, preferably from 1 to 30% by weight, of a water-soluble salen-type manganese complex,
b) from 10 to 95% by weight of a dissolution restrainer,
c) from 0 to 20% by weight of a further additive and
d) from 1 to 15% by weight of water, based on the total weight of the granules.

As manganese complexes for the granules according to the invention there come into consideration compounds that contain, complexed with manganese, from 1 to 3 saldimine groups, that is to say, groups obtainable by condensing unsubstituted or substituted salicylaldehydes with amines.

Especially suitable are compounds of formula (1)

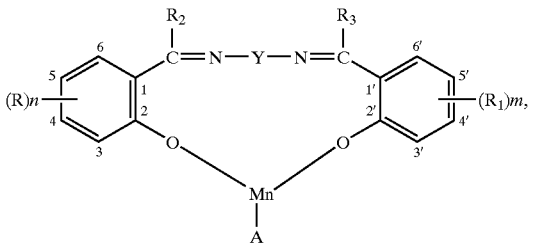

-continued (2)

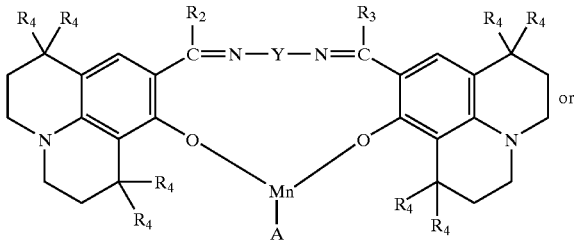

or (3)

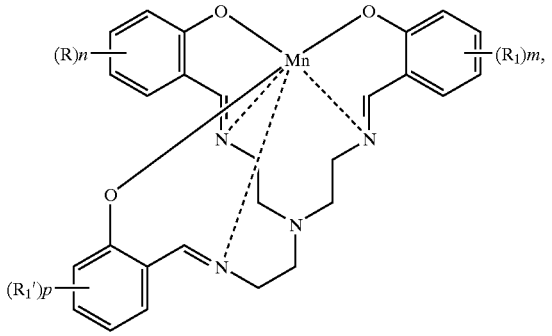

wherein

A is an anion;

m, n and p are each independently of the others 0, 1, 2 or 3, $R_4$ is hydrogen or linear or branched $C_1$–$C_4$alkyl, Y is a linear or branched alkylene radical of formula —$[C(R_4)_2]_r$—, wherein r is an integer from 1 to 8 and the $R_4$ radicals are each independently of the others as defined above; —CX=CX—, wherein X is cyano, linear or branched $C_1$–$C_8$alkyl or di(linear or branched $C_1$–$C_8$alkyl)amino; —$(CH_2)_q$—$NR_4$—$(CH_2)_q$—, wherein $R_4$ is as defined above and q is 1, 2, 3 or 4; or a 1,2-cyclohexylene radical of formula:

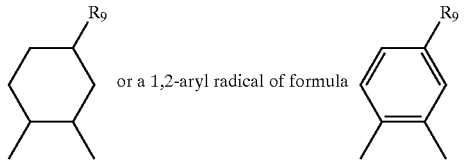

or a 1,2-aryl radical of formula wherein $R_9$ is hydrogen, $SO_3H$, $CH_2OH$ or $CH_2NH_2$, R, $R_1$ and $R_1'$ are each independently of the others cyano; halogen; $OR_4$ or $COOR_4$ wherein $R_4$ is as defined above; nitro; linear or branched $C_1$–$C_8$alkyl; linear or branched partially fluorinated or perfluorinated $C_1$–$C_8$alkyl; or $NHRR_6$, $NR_5R_6$ or $N^{\oplus}R_5R_6R_7$ wherein $R_5$, $R_6$ and $R_7$ are the same or different and are each hydrogen or linear or branched $C_1$–$C_{12}$alkyl or wherein $R_5$ and $R_6$ together with the nitrogen atom to which they are bonded form a 5-, 6- or 7-membered ring, which may contain further hetero atoms, or are linear or branched $C_1$–$C_8$alkyl-$R_6$ wherein $R_6$ is a radical $OR_4$, $COOR_4$ or $NR_5R_6$ as defined above or is $NH_2$ or $N^{\oplus}R_5R_6R_7$ wherein $R_5$, $R_6$ and $R_7$ are as defined above, $R_2$ and $R_3$ are each independently of the other hydrogen, linear or branched $C_1$–$C_4$alkyl, unsubstituted aryl or aryl that is substituted by cyano, by halogen, by $OR_4$ or $COOR_4$ wherein $R_4$ is hydrogen or linear or branched $C_1$–$C_4$alkyl, by nitro, by linear or branched $C_1$–$C_8$alkyl, by $NHR_5$ or $NR_5R_6$, wherein $R_5$ and $R_5$ are the same or different and are each linear or branched $C_1$–$C_{12}$alkyl or wherein $R_5$ and $R_5$ together with the nitrogen atom to which they are bonded form a 5-, 6- or 7-membered ring, which may contain further hetero atoms, by linear or branched $C_1$–$C_8$alkyl-$R_7$ wherein $R_7$ is an $OR_4$, $COOR_4$ or $NR_5R_6$ radical as defined above or is $NH_2$, or by $N^{\oplus}R_5R_6R_7$ wherein $R_5$, $R_6$ and $R_7$ are as defined above.

When, in the compounds of formulae (1) and (3), R, $R_1$, $R_1$' and/or $R_8$ are $N^{\oplus}R_5R_6R_7$ or $R_2$ and/or $R_3$ are $N^{\oplus}R_5R_6R_7$ substituted aryl wherein $R_5$, $R_6$ and $R_7$ are as defined above, the following anions are suitable for balancing the positive charge on the $N^{\oplus}R_5R_6R_7$ group: halide, for example chloride, perchlorate, sulfate, nitrate, hydroxide, $BF_4^-$, $PF_6^-$, carboxylate, acetate, tosylate and triflate. Of those anions, bromide and chloride are preferred.

In compounds of formulae (1) and (3) in which n, m or p is 2 or 3, the radicals R, $R_1$ and $R_1$' have the same or different meanings.

When Y is a 1,2-cyclohexylene radical, it may be present in any of its stereoisomeric cisitrans forms.

Preferably, Y is a radical of formula —$(CH_2)_r$— wherein r is an integer from 1 to 4, especially 2, or is a radical of formula —$C(R_4)_2$—$(CH_2)P$—$C(R_4)_2$— wherein p is a number from 0 to 3, especially 0, and each $R_4$, independently of the others, is hydrogen or $C_1$–$C_4$alkyl, especially hydrogen or methyl, or is a 1,2-cyclohexylene radical or a 1,2-phenylene radical of formula:

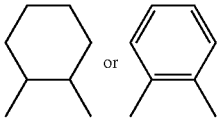

Halogen is preferably chlorine, bromine or fluorine, chlorine being especially preferred.

When n, m or p is 1, the groups R, $R_1$ and $R_1$' are preferably in the 4-position of the respective benzene ring except when R, $R_1$ or $R_1$' is nitro or $COOR_4$, in which case that group is preferably in the 5-position. When R, $R_1$ or $R_1$' is a $N^{\oplus}R_5R_6R_7$ group, that group is preferably in the 4- or 5-position.

When n, m or p is 2, the two R, $R_1$ or $R_1$' groups are preferably in the 4,6-position of the respective benzene ring except when they are nitro or $COOR_5$, in which case the two groups are preferably in the 3,5-position.

When R, $R_1$ or $R_1$' is di($C_1$–$C_{12}$alkyl)amino, the alkyl group may be straight-chain or branched.

Preferably, it contains from 1 to 8, especially from 1 to 3, carbon atoms.

Preferably, the radicals R, $R_1$ and $R_1$' are hydrogen, $OR_4$, $N(R_4)_2$ or $N^{\oplus}(R_4)_3$, wherein the $R_4$ groups in $N(R_4)_2$ or $N^{\oplus}(R_4)_3$ may be different and are hydrogen or $C_1$–$C_4$alkyl, especially methyl, ethyl or isopropyl.

The radicals $R_2$ and $R_3$ are especially hydrogen, methyl, ethyl or unsubstituted phenyl.

Aryl is, for example, naphthyl or, especially, phenyl.

When $R_5$ and $R_6$ together with the nitrogen atom to which they are bonded form a 5-, 6- or 7-membered ring, the ring is especially a pyrrolidine, piperidine, morpholine or piperazine ring. The piperazine ring may be substituted, for example by alkyl, at the nitrogen atom that is not bonded to the phenyl or alkyl radical.

Suitable anions A include, for example, halide, such as chloride or bromide, perchlorate, sulfate, nitrate, hydroxide, $BF_4^-$, $PF_6^-$, carboxylate, acetate, tosylate and triflate. Of those anions, chloride, bromide and acetate are preferred.

The compounds of formulae (1), (2) and (3) are known or can be prepared in a manner known per se. The manganese complexes are prepared from the corresponding ligands and a manganese compound. Such preparation procedures are described, for example, in U.S. Pat. Nos. 5,281,578 and 4,066,459 and by Bernardo et al., Inorg. Chem. 45 (1996) 387.

Preferred formulations of the granules comprise from 1 to 90% by weight, especially from 1 to 30% by weight, of salen-type manganese complex of formula (1), (2) or (3), based on the total weight of the granules.

Instead of a single, homogeneous manganese complex of formula (1), (2) or (3) it is also possible to use mixtures of two or more manganese complexes of formula (1), (2) or (3). Mixtures of one or more manganese complexes of formula (1), (2) or (3) and one or more salen-type ligands can also be used. Salen-type ligands suitable for such mixtures include all ligands that are used as starting compounds in the preparation of the manganese complexes of formula (1), (2) and (3).

As dissolution restrainers for the granules according to the invention there come into consideration compounds that cause the manganese complexes to dissolve in water more slowly than they would without the dissolution restrainers. The following, for example, come into consideration:

1. anionic dispersing agents,
2. non-ionic dispersing agents and
3. water-soluble organic polymers.

The anionic dispersing agents used are, for example, the commercially available water-soluble anionic dispersing agents for dyes, pigments etc. The following products, especially, come into consideration: condensation products of aromatic sulfonic acids and form-aldehyde, condensation products of aromatic sulfonic acids with unsubstituted or chlorinated diphenylene or diphenyl oxides and, optionally, formaldehyde, (mono-/di-)alkylnaphthalene-sulfonates, sodium salts of polymerised organic sulfonic acids, sodium salts of polymerised alkylnaphthalenesulfonic acid, sodium salts of polymerised alkylbenzenesulfonic acid, alkylarylsulfonates, sodium salts of alkyl polyglycol ether sulfates, polyalkylated polynudear arylsultonates, methylene-linked condensation products of arylsulfonic acids and hydroxy-arylsulfonic acids, sodium salts of dialkylsulfosuccinic acid, sodium salts of alkyl diglycol ether sulfates, sodium salts of polynaphthalenemethanesulfonates, ligno- or oxyligno-sulfonates and heterocyclic polysulfonic acids.

The following anionic dispersing agents are especially suitable: condensation products of naphthalenesulfonic acids with formaldehyde, sodium salts of polymerised organic sulfonic acids, (mono-/di-) alkylnaphthalenesulfonates, polyalkylated polynuclear arylsultonates, sodium salts of polymerised alkylbenzene-sulfonic acid, lignosulfonates, oxyligno-sulfonates and condensation products of naphthalenesulfonic acid with a polychloromethyldiphenyl.

Suitable non-ionic dispersing agents are especially compounds having a melting point of at least 35° C. that are emulsifiable, dispersible or soluble in water. They include, for example, the following compounds:

1. fatty alcohols having from 8 to 22 carbon atoms, especially cetyl alcohol,
2. addition products of preferably from 2 to 80 mol of alkylene oxide, especially ethylene oxide, in which individual ethylene oxide units may have been replaced by substituted epoxides, such as styrene oxide and/or propylene oxide, with higher unsaturated or saturated monoalcohols, fatty acids, fatty amines or fatty amides having from 8 to 22 carbon atoms, or with benzyl alcohols, phenylphenols, benzylphenols or alkylphenols in which the alkyl radicals have at least 4 carbon atoms, 3. alkylene oxide condensation products, especially propylene oxide condensation products (block polymers),
4. ethylene oxide/propylene oxide adducts with diamines, especially ethylenediamine,
5. reaction products of a fatty acid having from 8 to 22 carbon atoms with a primary or secondary amine having at least one hydroxy-lower alkyl or lower alkoxy-lower alkyl group, or alkylene oxide addition products of such hydroxyalkylgroup-containing reaction products,
6. sorbitan esters, preferably having long-chained ester groups, or ethoxylated sorbitan esters, such as, for example, polyoxyethylene-sorbitan monolaurate having from 4 to 10 ethylene oxide units or polyoxyethylene-sorbitan trioleate having from 4 to 20 ethylene oxide units,
7. addition products of propylene oxide with a tri- to hexa-hydric aliphatic alcohol having from 3 to 6 carbon atoms, for example glycerol or pentaerythritol, and
8. fatty alcohol polyglycol mixed ethers, especially addition products of from 3 to 30 mol of ethylene oxide and from 3 to 30 mol of propylene oxide with aliphatic monoalcohols having from 8 to 22 carbon atoms.

Non-ionic dispersing agents that are especially suitable are surfactants of formula $$R_{11}—O\text{-}(\text{alkylene-O})_n—R_{12} \quad (4)$$

wherein $R_{11}$ is $C_8$–$C_{22}$alkyl or $C_8$-$C_{18}$alkenyl;

$R_{12}$ is hydrogen; $C_1$–$C_4$alkyl; a cycloaliphatic radical having at least 6 carbon atoms or benzyl;

"alkylene" is an alkylene radical having from 2 to 4 carbon atoms and n is a number from 1 to 60.

The substituents $R_{11}$ and $R_{12}$ in formula (4) are advantageously the hydrocarbon radical of an unsaturated or, preferably, saturated aliphatic monoalcohol having from 8 to 22 carbon atoms. The hydrocarbon radical may be straight-chain or branched. Preferably, $R_{11}$ and $R_2$ are each independently of the other an alkyl radical having from 9 to 14 carbon atoms.

As saturated aliphatic monoalcohols there come into consideration natural alcohols, such as, for example, lauryl alcohol, myristyl alcohol, cetyl alcohol and stearyl alcohol, as well as synthetic alcohols, such as, for example, 2-ethylhexanol, 1,1,3,3-tetramethylbutanol, octan-2-ol, isononyl alcohol, trimethylhexanol, trimethylnonyl alcohol, decanol, $C_9$–$C_1$ oxoalcohol, tridecyl alcohol, isotridecyl alcohol and linear primary alcohols (Alfols) having from 8 to 22 carbon atoms. Some examples of such Alfols are Alfol (8–10), Alfol (9–11), Alfol (10–14), Alfol (12–13) and Alfol (1618). ("Alfol" is a registered trade mark).

Unsaturated aliphatic monoalcohols are, for example, dodecenyl alcohol, hexadecenyl alcohol and oleyl alcohol.

The alcohol radicals may be used individually or in the form of mixtures of two or more components, such as, for example, mixtures of alkyl and/or alkenyl groups derived from soybean fatty acids, palm-kernel fatty acids or tallow oils.

(Alkylene-O) chains are preferably divalent radicals of formula

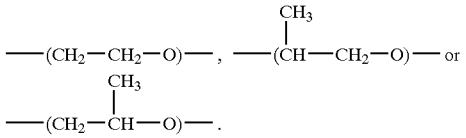

Examples of a cycloaliphatic radical are cycloheptyl, cyclooctyl and, preferably, cyclohexyl.

As non-ionic dispersing agents there preferably come into consideration surfactants of formula

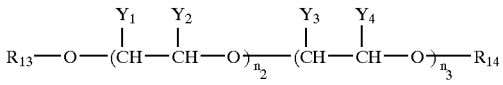

(5)

wherein $R_{13}$ is $C_8$–$C_{22}$alkyl;

$R_{14}$ is hydrogen or $C_1$–$C_4$alkyl;

$Y_1$, $Y_2$, $Y_3$ and $Y_4$ are each independently of the others hydrogen, methyl or ethyl:

$n_2$ is a number from 0 to 8; and $n_3$ is a number from 2 to 40.

Further important non-ionic dispersing agents correspond to the formula

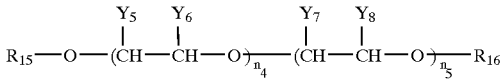

(6)

wherein $R_{15}$ is $C_9$–$C_{14}$alkyl;

$R_{16}$ is $C_1$–$C_4$alkyl;

$Y_5$, $Y_6$, $Y_7$ and $Y_8$ are each independently of the others hydrogen, methyl or ethyl, one of the radicals $Y_5$, $Y_6$ and one of the radicals $Y_7$, $Y_8$ always being hydrogen; and $n_4$ and $n_5$ are each independently of the other an integer from 4 to 8.

The non-ionic dispersing agents of formulae (4) to (6) can be used in the form of mixtures.

There come into consideration as surfactant mixtures, for example, non-end-group-terminated fatty alcohol ethoxylates of formula (4), that is to say, compounds of formula (4) wherein $R_{11}$ is $C_8$–$C_{22}$alkyl, $R_{12}$ is hydrogen and the alkylene-O chain is the radical —($CH_2$—$CH_2$—O)— as well as end-group-terminated fatty alcohol ethoxylates of formula (6).

As examples of non-ionic dispersing agents of formulae (4), (5) and (6) there may be mentioned reaction products of a $C_{10}$–$C_{13}$fatty alcohol, for example a $C_{13}$oxoalcohol, with from 3 to 10 mol of ethylene oxide, propylene oxide and/or butylene oxide, or the reaction product of 1 mol of a $C_{13}$fatty alcohol with 6 mol of ethylene oxide and 1 mol of butylene oxide, it being possible for the addition products in each case to be terminated by a $C_1$–$C_4$alkyl end group, preferably methyl or butyl.

The dispersing agents may be used individually or in the form of mixtures of two or more dispersing agents.

Instead of or in addition to the anionic or non-ionic dispersing agent, the granules according to the invention may comprise a water-soluble organic polymer as dissolution restrainer. Such polymers may be used individually or in the form of mixtures of two or more polymers. Preferably, such a polymer is added for the purpose of improving the mechanical stability of the granules and/or when, during later use of the granules in the washing agent, the dissolution of the salen-type manganese complex in the washing liquor is to be controlled, and/or when an enhanced action as dye inhibitor is desired.

As water-soluble polymers there come into consideration, for example, polyethylene glycols, copolymers of ethylene oxide with propylene oxide, gelatin, polyacrylates, polymethacrylates, polyvinylpyrrolidones, vinylpyrrolidones, vinyl acetates, polyvinylimidazoles, polyvinylpyridine N-oxides, copolymers of vinylpyrrolidone with long-chained α-olefins, copolymers of vinylpyrrolidone with vinylimidazole, poly(vinylpyrrolidone/dimethylaminoethyl methacrylates), copolymers of vinylpyrrolidone/dimethylaminopropyl melhacrylamides, copolymers of vinylpyrrolidone/dimethylaminopropyl acrylamides, quaternised copolymers of vinylpyrrolidones and dimethylaminoethyl methacrylates, terpolymers of vinylcapro-lactam/vinylpyrrolidone/dimethylaminoethyl methacrylates, copolymers of vinylpyrrolidone and methacrylamidopropyl-trimethylammonium chloride, terpolymers of caprolactam/vinyl-pyrrolidoneldimethylaminoethyl methacrylates, copolymers of styrene and acrylic acid, polycarboxylic acids, polyacrylamides, carboxymethylcellulose, hydroxymethylcellulose, polyvinyl alcohols, optionally hydrolysed polyvinyl acetate, copolymers of ethyl acrylate with methacrylate and methacrylic acid, copolymers of maleic acid with unsaturated hydrocarbons and mixed polymerisation products of the said polymers.

Among those organic polymers, special preference is given to carboxymethylcellulose, polyacrylamides, polyvinyl alcohols, polyvinylpyrrolidones, gelatin, hydrolysed polyvinyl acetate, copolymers of vinylpyrrolidone and vinyl acetate and also polyacrylates, copolymers of ethyl acrylate with methacrylate and methacrylic acid and polymethacrylates.

The dissolution restrainers are used in an amount of from 10 to 95% by weight, preferably from 15 to 85% by weight and especially from 25 to 75% by weight, based on the total weight of the granules.

The granules according to the invention may comprise further additives, for example wetting agents, water-insoluble or water-soluble dyes or pigments and also fillers and optical brighteners. Such additives are present in an amount of from 0 to 20% by weight, based on the total weight of the granules.

The granules according to the invention are prepared, for example, starting from:

a) a solution or suspension with a subsequent drying/forming step or b) a suspension of the active ingredient in a melt, with subsequent forming and solidification.

a) First, the anionic or non-ionic dispersing agent and/or the polymer and, as appropriate, the further additives are dissolved in water and stirred, optionally with heating, until a homogeneous solution is obtained. The salen-type manganese complex is then dissolved or suspended in the resulting aqueous solution. The solids content of the solution should preferably be at least 30% by weight, more especially from 40 to 50% by weight, based on the total weight of the solution. The viscosity of the solution is preferably less than 200 mPas.

In a drying step all the water, with the exception of a residual amount, is then removed from the so-prepared aqueous solution comprising the salen-type manganese complex, solid particles (granules) simultaneously being formed. Known methods are suitable for producing the granules from the aqueous solution. In principle, both methods with continuous operation and those with discontinuous operation are suitable. Preference is given to continuous processes, especially spray-drying granulation methods and fluidised-bed granulation methods.

Spray-drying methods in which the active ingredient solution is sprayed into a chamber in which hot air is being circulated are especially suitable. The atomisation of the solution is carried out, for example, using unitary or binary nozzles or is brought about by the spinning effect of a rapidly rotating disc. In order to increase the particle size, the spray-drying procedure can be combined with an additional agglomeration of the liquid particles with solid nuclei in a fluidised bed integrated in the chamber (so-called fluid-spray). The fine particles (<100 μm) obtained by a conventional spray-drying method may, if necessary after being separated from the exhaust air flow, be fed directly, without being further treated, to the atomizing cone of the spray-dryer atomizer, as nuclei for the purpose of agglomeration with the liquid droplets of the active ingredient.

During the granulation step, the water can rapidly be removed from the solutions comprising the salen-type manganese complex, dissolution restrainer and further additives, and it is expressly intended that agglomeration of the droplets forming in the atomizing cone, or the agglomeration of droplets with solid particles, will take place.

If necessary, the granules formed in the spray-dryer are separated off in a continuous process, for example by means of a sieving operation. The fine particles and the oversize particles are either recycled in the process directly (without being dissolved) or are dissolved in the liquid active ingredient formulation and then granulated again.

The granules according to the invention are resistant to abrasion, low in dust, are free-flowing and easily metered. A distinguishing feature is that their rate of dissolution in water is controllable by the composition of the formulation. They are used especially in washing agent formulations as dye-transfer inhibitors. They can be added directly to a washing agent formulation at the desired concentration of the salen-type manganese complex. The present invention relates also to that use.

Where the coloured appearance of the granules in the washing agent is to be suppressed, that can be achieved, for example, by embedding the granules in droplets consisting of a whitish meltable substance ('water-soluble wax'), or by adding a white pigment (e.g.$TiO_2$) to the granule formulation or, preferably, by encasing the granules with a melt consisting, for example, of a water-soluble wax, as described in EP-B-0 323 407 B1, a white solid (e.g. titanium dioxide) being added to the melt in order to reinforce the masking effect of the casing.

b) Prior to granulation of the melt, the salen-type manganese complex is dried in a separate step and, if necessary, dry-ground in a mill so that all solid particles are <50 μm. The drying is carried out in an apparatus customary for that purpose, for example in a paddle dryer, a vacuum cabinet or a freeze-dryer.

The finely particulate manganese complex is suspended in the molten carrier material and the suspension is homogenised. The desired granules are prepared from the suspension in a forming step with simultaneous solidification of the melt. The selection of a suitable melt-granulation method is dependent upon the desired size of the granules. In principle, any method that allows the production of granules of a particle size of from 0.1 to 4 mm is suitable. Such methods include droplet-dispensing processes (with solidification on a cooling belt), prilling (gas/liquid cooling medium) and flake formation with a subsequent comminution step, the granulating apparatus being operated continuously or discontinuously.

Where the coloured appearance of the granules in the washing agent is to be suppressed, there can also be suspended in the melt, in addition to the manganese complex, white or coloured pigments (e.g. titanium dioxide) that impart the desired colour appearance to the granules after solidification.

The present invention accordingly relates also to washing agent formulations comprising I) from 5 to 90%, preferably from 5 to 70%, A) of an anionic surfactant and/or B) of a non-ionic surfactant, II) from 5 to 70%, preferably from 5 to 50%, especially from 5 to 40%, C) of a builder substance, III) from 0.1 to 30%, preferably from 1 to 12%, D) of a peroxide and IV) E) granules according to the invention in such an amount that the washing agent formulation comprises from 0.005 to 2%, preferably from 0.02 to 1%, especially from 0.1 to 0.5%, of the pure manganese complex of formula (1), (2) or (3). In each case, the percentage figures are percentages by weight, based on the total weight of the washing agent.

The washing agent may be in solid or liquid form, but in liquid form it is preferably a non-aqueous washing agent containing not more that 5% by weight, preferably from 0 to 1% by weight, of water and comprising as base a suspension of a builder substance in a non-ionic surfactant, for example as described in GB-A-2 158 454.

The washing agent is preferably, however, in the form of a powder or granules.

The powder or granules can be produced, for example, by first of all preparing a starting powder by spray-drying an aqueous suspension comprising all of the components listed above, with the exception of components D) and E), and then adding the dry components D) and E) and mixing everything together.

It is also possible to start with an aqueous suspension that comprises components A) and C) but not component B) or only a proportion of component B). The suspension is spray-dried and then component E) is mixed with component B) and the mixture is added to the suspension, and subsequently component D) is admixed dry.

Preferably, the components are mixed together in such amounts that a solid compact washing agent in the form of granules is obtained that has a specific weight of at least 500 g/l.

In a further preferred embodiment, the washing agent is prepared in three steps. In the first step a mixture of anionic surfactant (and, if desired, a small amount of non-ionic surfactant) and builder substance is prepared. In the second step that mixture is sprayed with the bulk of the non-ionic surfactant, and then in the third step peroxide, catalyst as appropriate, and the granules according to the invention are added. That method is normally carried out in a fluidised bed.

In a further preferred embodiment, the individual steps are not carried out completely separately, resulting in a certain amount of overlap between them. Such a method is usually carried out in an extruder, in order to obtain granules in the form of "megapearls".

The anionic surfactant A) may be, for example, a sulfate, sulfonate or carboxylate surfactant or a mixture of such surfactants.

Preferred sulfates are those having from 12 to 22 carbon atoms in the alkyl radical, where appropriate in combination with alkyl ethoxysulfates in which the alkyl radical contains from 10 to 20 carbon atoms.

Preferred sulfonates include, for example, alkylbenzenesulfonates having from 9 to 15 carbon atoms in the alkyl radical and/or alkylnaphthalenesulfonates having from 6 to 16 carbon atoms in the alkyl radical.

The cation in the anionic surfactants is preferably an alkali metal cation, especially sodium.

Preferred carboxylates are alkali metal sarcosinates of formula R—CO—N($R^1$)—$CH_2COOM^1$, wherein R is alkyl or alkenyl having from 8 to 18 carbon atoms in the alkyl or alkenyl radical, $R^1$ is $C_1$–$C_4$alkyl and $M^1$ is an alkali metal.

The non-ionic surfactant B) may be, for example, a condensation product of from 3 to 8 mol of ethylene oxide with 1 mol of primary alcohol that contains from 9 to 15 carbon atoms.

There come into consideration as builder substance C), for example, alkali metal phosphates, especially tripolyphosphates, carbonates or bicarbonates, especially the sodium salts thereof, silicates, aluminium silicates, polycarboxylates, polycarboxylic acids, organic phosphonates, aminoalkylenepoly(alkylenephosphonates) and mixtures of such compounds.

Especially suitable silicates are sodium salts of crystalline layer silicates of the formula $NaHSi_tO_{2t+1}.pH_2O$ or $Na_2Si_tO_{2t+1}.pH_2O$ wherein t is a number from 1.9 to 4 and p is a number from 0 to 20.

Among the aluminium silicates, preference is given to those obtainable commercially under the names zeolite A, B, X and HS and also to mixtures of two or more of those components.

Among the polycarboxylates, preference is given to polyhydroxycarboxylates, especially citrates, and acrylates and also copolymers thereof with maleic anhydride.

Preferred polycarboxylic acids are nitrilotriacetic acid, ethylenediaminetetraacetic acid and ethylenediamine disuccinate either in racemic form or in the enantiomerically pure S,S form.

Especially suitable phosphonates and aminoalkylenepoly (alkylenephosphonates) include alkali metal salts of 1-hydroxyethane-1,1-diphosphonic acid, nitrilotris (methylenephos-phonic acid), ethylenediaminetetramethylenephosphonic acid and diethylenetriaminepentamethylenephos-phonic acid.

As the peroxide component D) there come into consideration, for example, the organic and inorganic peroxides known in the literature and available commercially that bleach textiles at conventional washing temperatures, for example at from 10 to 95° C.

The organic peroxides are, for example, mono- or polyperoxides, especially organic peracids or salts thereof, such as phthalimidoperoxycaproic acid, peroxybenzoic acid, diperoxydodecanedioic acid, diperoxynonanedioic acid, diperoxydecanedioic acid, diperoxyphthalic acid or salts thereof.

Preference is given, however, to the use of inorganic peroxides, such as, for example, persulfates, perborates, percarbonates and/or persilicates. It will be understood that it is also possible to use mixtures of inorganic and/or organic peroxides. The peroxides may be in a variety of crystalline forms and may have different water contents, and they may also be used together with other inorganic or organic compounds in order to improve their storage stability.

The peroxides are added to the washing agent preferably by mixing the components together, for example using a screw metering system and/or a fluidised bed mixer.

The washing agent may comprise, in addition to the granules according to the invention, one or more optical brighteners, for example from the group bistriazinylaminostilbene-disulfonic acid, bistriazolylstilbenedisulfonic acid, bisstyrylbiphenyl or bisbenzofuranylbiphenyl, a bisbenzoxalyl derivative, bisbenzimidazolyl derivative, coumarin derivative or a pyrazoline derivative.

The washing agents may furthermore comprise suspending agents for dirt, e.g. sodium carboxymethylcellulose, pH regulators, e.g. alkali metal or alkaline earth metal silicates, foam regulators, e.g. soap, salts for regulating the spray-drying and the granulating properties, e.g. sodium sulfate, perfumes and, optionally, antistatic agents and softeners, enzymes, such as amylase, bleaching agents, pigments and/or toning agents. It will be understood that such components must be stable towards the bleaching agent used.

Further preferred additives for the washing agents according to the invention are polymers that, during the washing of textiles, inhibit staining caused by dyes in the washing liquor that have been released from the textiles under the washing conditions. Such polymers are preferably polyvinylpyrrolidones, polyvinylimidazoles or polyvinylpyridine N-oxides which may have been modified by the incorporation of anionic or cationic substituents, especially those having a molecular weight in the range from 5000 to 60 000, more especially from 10 000 to 50 000. Such polymers are used preferably in an amount of from 0.05 to 5% by weight, especially from 0.2 to 1.7% by weight, based on the total weight of the washing agent.

In addition, the washing agents according to the invention may also comprise so-called perborate activators, such as, for example, TAED, SNOBS or TAGU, Preference is given to TAED, which is preferably used in an amount of from 0.05 to 5% by weight, especially from 0.2 to 1.7% by weight, based on the total weight of the washing agent.

The following Examples serve to illustrate the invention without the invention being limited thereto. Parts and percentages are by weight unless specified otherwise. The manganese complexes used in the Examples are the compounds of formulae (1a), (1b) and (3a):

(1a)

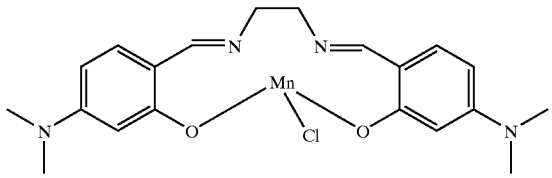

(1b)

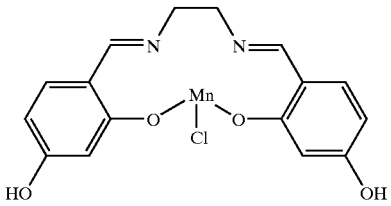

-continued (3a)

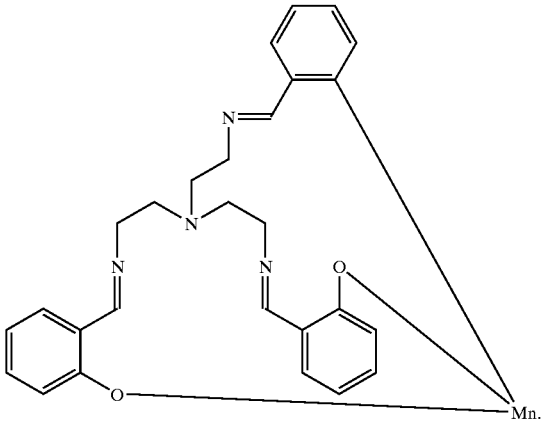

5 different granules are used in the Examples.

EXAMPLE 1

150 g of polyvinyl alcohol (PVA) (MW=15 000) are dissolved in 850 g of water at approximately 50° C. After the PVA has dissolved completely, 7.5 g of filter cake (active content=45.3%) of the manganese complex of structure (1a) are added to the solution and the complex is dissolved with stirring.

The solution is then spray-dried in a spray-dryer equipped with a binary nozzle. The exhaust-air temperature is 120° C. at a feed-air temperature of 210° C. Free-flowing granules having a mean particle size of 15 μm and a residual water content of 10% are obtained. The granules produced in that manner contain 2% of the manganese complex of structure (1a).

EXAMPLES 2 TO 4

Granules having the following compositions are produced according to the same procedure:

| Ex. No. | Manganese complex | % by wt. of manganese complex | Polymer | % by wt. of polymer | % by wt. of residual moisture in the granules |
|---|---|---|---|---|---|
| 2 | structure (1a) | 2 | sodium carboxymethylcellulose | 87 | 11 |
| 3 | structure (1a) | 2 | gelatin | 84 | 14 |
| 4 | structure (1a) | 2 | copolymer of ethyl acrylate with methacrylate and methacrylic acid | 91 | 7 |

EXAMPLE 5

Moist filter cake of the manganese complex of structure (1a) is dried in a vacuum cabinet to a residual moisture content of 5.2%. The dried manganese complex is ground in a laboratory mill to a mean particle size of 36 μm.

200 g of polyethylene glycol 8000 (melting point 63° C.) are introduced as initial charge into a 4-double-walled vessel equipped with a stirrer and a heatable outlet (modified to form a nozzle having a diameter of 0.8 mm). The polyethylene glycol is heated to 120° C. under nitrogen. 2.042 g of the ground manganese complex of structure (1a) are stirred into the hot melt and the suspension is homogenised for a further 30 minutes.

The hot suspension is slowly dispensed in droplets onto a cooled rotating metal plate. The hot droplets solidify in approximately 10 seconds to form the desired granules having an average diameter of 2 mm. The size of the granules can be controlled, for example, by the temperature of the melt. The granules contain 2% of the manganese complex of structure (1a).

EXAMPLE 6

Release of the Manganese Complex into Solution

The rate at which the granules release the manganese complex into an alkaline solution at 40° C. is determined as follows:

0.1107 g of granules is added with stirring, at time 0, to 100 ml of borax buffer (pH=10. 0.03 g of disodium tetraborate and 0.042 g/l of sodium hydroxide). After set intervals, a sample of the solution is taken and an absorption spectrum thereof is measured. The manganese complex has an absorption band at 405 nm. The optical density of a solution of 0.022 gA of the fully dissolved catalyst at 405 nm is 1.6. The Table below shows the results. It will be seen from the Table that the various granules release the manganese complex into the solution in a slow and controlled manner.

| Granules from | Optical density at 405 nm | | | | | | | |
|---|---|---|---|---|---|---|---|---|
| Example | 1 min | 7 min | 13 min | 19 min | 25 min | 31 min | 60 min | 120 min |
| 1 | 0.06 | 0.34 | 0.60 | 0.77 | 0.92 | 1.02 | 1.26 | 1.35 |
| 2 | — | 0.24 | 0.40 | 0.55 | 0.68 | 0.78 | 1.05 | 1.23 |
| 3 | 0.49 | 1.41 | 1.57 | 1.57 | 1.57 | 1.57 | 1.57 | — |
| 4 | 0.86 | 1.11 | 1.12 | 1.14 | 1.15 | 1.16 | 1.20 | — |
| 5 | 0.77 | 1.63 | 1.63 | 1.63 | 1.63 | 1.63 | 1.63 | — |

EXAMPLE 7

In order to examine the effectiveness of the granules as dye-transfer inhibitors, the DTI activity is determined. The DTI (dye transfer inhibition) activity a is defined as the following percentage:

$$a=([Y(E)-Y(A)]/[Y(W)-Y(A)])*100$$

wherein Y(W), Y(A) and Y(E) denote the CIE brightness values of the white material, of the material treated without the addition of dye-transfer inhibitor and of the material treated with the addition of dye-transfer inhibitor, respectively. a=0 denotes a completely ineffective product, which when added to the washing liquor allows the dye transfer to proceed freely, whereas a=100% corresponds to a perfect dye-transfer inhibitor, which completely prevents staining of the white material.

The following test system is used to obtain the test data: 5 g of white cotton fabric are treated in 80 ml of washing liquor. The liquor comprises the standard washing agent ECE phosphate-free (456 IEC) EMPA, Switzerland, in a concentration of 7.5 gA, 8.6 mmol/l of $H_2O_2$ and 5 g of cotton fabric dyed with dyestuff R Bk 5 (Reactive Black 5). The washing procedure is carried out in a beaker in a LINITEST apparatus for 30 min. at 40° C. The dye-transfer inhibitor is added in the amount indicated in each case. The reflection spectra of the specimens are measured using a SPECTRAFLASH 2000 and converted into brightness values (065/10) by standard CIE procedure.

It will be seen from the Table below that the granules exhibit a significantly better DTI activity than the pure manganese complex, although the absolute amount of pure manganese complex metered in is the same in all 6 experiments.

| Dye-transfer inhibitor | 0.00177 g (1a)* | 0.0886 g of granules from Example 1 | 0.0886 g of granules from Example 2 | 0.0886 g of granules from Example 3 | 0.0886 g of granules from Example 4 | 0.0886 g of granules from Example 5 |
|---|---|---|---|---|---|---|
| a (%) | 0 | 38 | 57 | 27 | 18 | 58 |

*The indicated amount of pure manganese complex is metered in in the form of a concentrated methanolic solution. See Example 1 for the definition of dye-transfer inhibitors.

EXAMPLE 8

The following test system is used to obtain the test data: 7.5 g of white cotton fabric are treated for 30 min. at 40° C. in 80 ml of washing liquor. The liquor comprises the standard washing agent ECE phosphate-free (456 IEC) EMPA, Switzerland, in a concentration of 7.5 g/l and 8.6 mmol/l of $H_2O_2$. R Bk 5 in the 133% formulation is used as dyestuff. Using a computer-controlled feed pump, the dyestuff is slowly metered in during the washing procedure in the form of a concentrated solution. In that way, the slow bleeding of dyes from coloured textiles is simulated. The concentration of dyestuff in the washing liquor as a function of time (K(t), K in mg/l, t in min.), without dye-transfer inhibitor and without fabric, is described by the function:

$$K(t)=4.9\cdot(1-\exp(-0.059\cdot t))+8.0\ (1-\exp(-1.46\cdot t))$$

The concentration of dyestuff after 30 min. is accordingly 12 mg/l. The dye-transfer inhibitor is added at the beginning of the experiment in the amount indicated in each case. The reflection spectra of the specimens are measured using a SPECTRAFLASH 2000 and converted into brightness values (D65/10) by standard CIE procedure.

It will be seen from the Table below that the granules exhibit a significantly better DTI activity [see Example 7 for the definition of a (%)] than the pure manganese complex, although the absolute amount of pure manganese complex metered in is the same in all 6 experiments.

| Dye-transfer inhibitor | 0.00177 g of (1a)* | 0.0886 g of granules from Example 1 | 0.0886 g of granules from Example 2 | 0.0886 g of granules from Example 3 | 0.0886 g of granules from Example 4 | 0.0886 g of granules from Example 5 |
|---|---|---|---|---|---|---|
| a (%) | 24 | 56 | 72 | 48 | 56 | 72 |

*The indicated amount of pure manganese complex was metered in in the form of a concentrated methanolic solution. See Example 1 for the definition of dye-transfer inhibitors.

EXAMPLE 9

0.1 g of compound (1b), 0.25 g of the dispersing agent 1618 (see below) and 4.65 g of the polymer PEG 8000 (see below) are melted at 80° C. and the melt is stirred until homogeneous. Using a plastics pipette, small amounts of the melt are dispensed in droplets onto a cooled metal plate. The solidified droplets have an average size of approximately 5 mm.

EXAMPLES 10 TO 30

The following formulations (see Table below) are prepared as described in Example 9. The compositions of the solid formulations are given in percent by weight.

Dispersing agent 1618=Marlipal 1618=RO($CH_2CH_2O)_{25}H$, R=saturated linear $C_{16}C_{18}$-fatty alcohol (Huls)

Pluronic F-108=EO/PO block polymer, M=15 500 (BASF)—

Lutensol AT 25=RO($CH_2CH_2O)_{25}H$, R=saturated linear $C_{16}C_{18}$ fatty alcohol (BASF)

Lutensol AT 50=RO($CH_2CH_2O)_{25}OH$, R=saturated linear $C_{16}C_{18}$ fatty alcohol (BASF)

PEG 20 000=polyethylene glycol, Mr=approx. 16 000–24 000 (Fluka)

EXAMPLE 31

A homogeneous suspension of 0.3 g of compound (1b) and 14.7 g of the dissolution restrainer Klucel E (see below) in 135 ml of deionised water is obtained after stirring for from 15 to 30 minutes. The suspension is dried at 80° C. and 120 mbar for three days. The formulation is cooled to −73° C. and pulverised in a mortar.

| Example | (1a) | (1b) | Disp. 1618 | Pluronic F-108 | Lutensol AT 25 | Lutensol AT 50 | PEG 8000 | PEG 20 000 |
|---|---|---|---|---|---|---|---|---|
| 10 | | 2 | | | | | 98 | |
| 11 | | 2 | 10 | | | | 88 | |
| 12 | | 2 | 15 | | | | 83 | |
| 13 | | 2 | | 5 | | | 93 | |
| 14 | | 2 | | | 5 | | 93 | |
| 15 | | 10 | | | | | 90 | |
| 16 | | 2 | 98 | | | | | |
| 17 | | 2 | | 98 | | | | |
| 18 | | 2 | | | 98 | | | |
| 19 | 2 | | 98 | | | | | |
| 20 | 2 | | | 98 | | | | |
| 21 | 2 | | | | 98 | | | |
| 22 | 2 | | 5 | | | | 93 | |
| 23 | 2 | | | 5 | | | 93 | |
| 24 | 2 | | | | 5 | | 93 | |
| 25 | 2 | | | | | | 20 | 78 |
| 28 | 2 | | | | | | 78 | 20 |
| 27 | | 2 | | | | | 20 | 78 |
| 28 | | 2 | | | | | 78 | 20 |
| 29 | | 10 | | | | 90 | | |
| 30 | 10 | | | | | 90 | | |

EXAMPLES 32 TO 41

The following formulations (see Table below) are prepared as described in Example 31. The compositions of the solid formulations are given in percent by weight.

| Example | (1a) | (1b) | Klucel E | PVP K-30 | Acrysol A-3 | Acrysol A-5 | Glascol E-11 |
|---|---|---|---|---|---|---|---|
| 32 | | 2 | 98 | | | | |
| 33 | | 2 | | 98 | | | |
| 34 | 2 | | 98 | | | | |
| 35 | 2 | | | 98 | | | |
| 36 | 10 | | | | 90 | | |
| 37 | 10 | | | | | 90 | |
| 38 | 10 | | | | | | 90 |
| 39 | | 10 | | | 90 | | |
| 40 | | 10 | | | | 90 | |
| 41 | | 10 | | | | | 90 |

Klucel E=hydroxypropyl cellulose, MW=80 000 (Aqualon Company)

PVP K-30=polyvinylpyrrolidone, Mr=80 000 (Erne Chemie)

Acrysol A-3=polyacrylic acid, MM<150 000 (Rohm and Haas)

Acrysol A-5=polyacrylic acid, MM<300 000 (Rohm and Haas)

Glascol E-11=polyacrylic acid, MM approx. 250 000 (Ciba Spezialitatenchemie)

EXAMPLE 42

A homogeneous suspension comprising 1 g of compound (1a) and 9 g of the dissolution restrainer PVP K-30 in 115 g of deionised water is prepared by stirring for from 15 to 30 minutes. While being continuously rotated in a methylene chloride/dry-ice bath (approximately −73° C.), the suspension is frozen in the form of a thin layer in a 1-liter pear-shaped flask and is then lyophilised.

EXAMPLES 43 TO 52

The following formulations (see Table below) are prepared as described in Example 42. The compositions of the solid formulations are given in percent by weight.

| Example | (1a) | (1b) | PVP K-30 | Acrysol A-1 | Acrysol A-3 | Acrysol A-5 | Goodrite K-702 |
|---|---|---|---|---|---|---|---|
| 43 | | 2 | 98 | | | | |
| 44 | 2 | | 98 | | | | |
| 45 | | 10 | | 90 | | | |
| 46 | | 10 | | | 90 | | |
| 47 | | 10 | | | | 90 | |
| 48 | | 10 | | | | | 90 |
| 49 | 10 | | | 90 | | | |
| 50 | 10 | | | | 90 | | |
| 51 | 10 | | | | | 90 | |
| 52 | 10 | | | | | | 90 |

Acrysol A-1=polyacrylic acid, MM<50 000 (Rohm and Haas)

Good-rite K-702=polyacrylic acid, Mw=243 000 (BFGoodrich)

EXAMPLE 53

A formulation is prepared as described in Example 9 from 10% by weight of compound (3a) and 90% by weight of Lutensol AT 50.

EXAMPLES 54–60

The test data are obtained in a manner analogous to that described in Example 8 of the Application. In all of the Examples below, the concentration of pure catalyst (1a) in the washing liquor is 50 $\mu$M (=22 mg/l).

| Example | Formulation from Example | DTI effect a (%) |
|---|---|---|
| 54 | 10 | 61 |
| 55 | 30 | 62 |
| 56 | 34 | 73 |
| 57 | 35 | 86 |
| 58 | 44 | 73 |
| 59 | 51 | 65 |
| 60 | 52 | 59 |

What is claimed is:

1. Slow and controlled dissolving water-soluble granules of salen manganese complexes, consisting essentially of a) from 1 to 89% by weight of a water-soluble salen manganese complex, b) from 10 to 95% by weight of a dissolution restrainer, c) from 0 to 20% by weight of a further additive and d) from 1 to 15% by weight of water, based on the total weight of the granules.

2. Granules according to claim 1 that comprise as salen manganese complex a compound of formula (1)

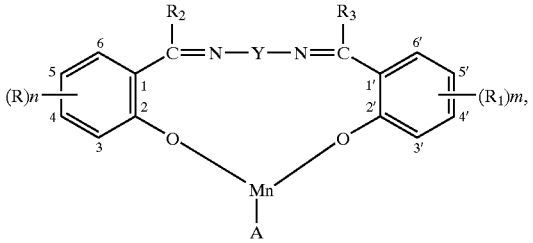

wherein

A is an anion;

m and n are each independently of the others 0, 1, 2 or 3, $R_4$ is hydrogen or linear or branched $C_1$–$C_4$alkyl, Y is a linear or branched alkylene radical of formula $[C(R_4)_2]_r$—, wherein r is an integer from 1 to 8 and the $R_4$ radicals are each independently of the others as defined above;

CX═CX—, wherein X is cyano, linear or branched $C_1$–$C_8$alkyl or di(linear or branched $C_1$–$C_8$alkyl) amino;

—$(CH_2)_q$—$NR_4$—$(CH_2)_q$, wherein $R_4$ is as defined above and q is 1, 2, 3 or 4; or a 1,2-cyclohexylene radical of formula:

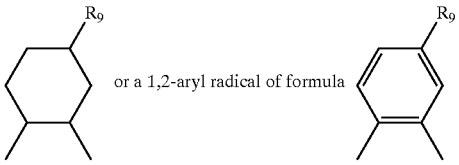

wherein $R_9$ is hydrogen, $SO_3H$, $CH_2OH$ or $CH_2NH_2$,

R and $R_1$ are each independently of the others cyano; halogen; $OR_4$ or $COOR_4$ wherein $R_4$ is as defined above; nitro; linear or branched $C_1$–$C_8$alkyl; linear or branched partially fluorinated or perfluorinated $C_1$-$C_8$alkyl; or $NHR_6$, $NR_5R_6$ or $N^{\oplus}R_5R_6R_7$ wherein $R_5$, $R_6$ and $R_7$ are the same or different and are each hydrogen or linear or branched $C_1$–$C_{12}$alkyl or wherein $R_5$ and $R_6$ together with the nitrogen atom 10 which they are bonded form a 1,6- or 7-membered ring, which may contain further hetero atoms, or are linear or branched $C_1$–$C_8$alkyl-$R_8$ wherein $R_8$ is a radical $OR_4$, $COOR_4$ or $NR_5R_6$ as defined above or is $NH_2$ or $N^{\oplus}R_5R_6R_7$ wherein $R_5$, $R_6$ and $R_7$ are as defined above, $R_2$ and $R_3$ are each independently of the other hydrogen, linear or branched $C_{1-14}$alkyl, unsubstituted aryl or aryl that is substituted by cyano, by halogen, by $OR_4$ or $COOR_4$ wherein $R_4$ is hydrogen or linear or branched $C_1$–$C_4$alkyl, by nitro, by linear or branched $C_1$–$C_8$alkyl, by $NHR_5$ or $NR_5R_6$, wherein $R_5$ and $R_6$ are the same or different and are each linear or branched $C_1$–$C_{12}$alkyl or wherein $R_5$ and $R_6$ together with the nitrogen atom to which they are bonded form a 1,6- or 7-membered ring, which may contain further hetero atoms, by linear or branched $C_1$–$C_8$alkyl-$R_7$ wherein $R_7$ is an OR, $COOR_4$ or $NR_5R_6$ radical as defined above or is $NH_2$, or by $N^{\oplus}R_5R_6R_7$ wherein $R_5$, $R_6$ and $R_7$ are as defined above.

3. Granules according to claim 2 wherein Y is a radical of formula —$(CH_2)_r$ wherein r is an integer from 1 to 4, or is a radical of formula —$C(R_4)_r(CH_2)_p$—$C(R_4)_r$ wherein p is a number from 0 to 3, and each $R_4$, independently of the others, is hydrogen or C—$C_4$alkyl, or is a 1,2-cyclohexylene radical or a 1,2-phenylene radical of formula:

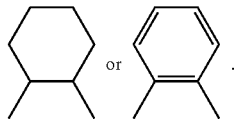

4. Granules according to claim 2 wherein the radicals R and $R_1$ we hydrogen, $OR_4$, $N(R_4)_2$ or $N^{\oplus}(R_4)_3$ and the R, groups in $N(R_4)_2$ or $N(R_4)_3$ may be different and are each hydrogen or $C_1$–$C_4$alkyl.

5. Granules according to claim 2 wherein the radicals $R_2$ and $R_3$ are hydrogen, methyl, ethyl or unsubstituted phenyl.

6. Granules according to claim 2 wherein the anion A is a halide, perchlorate, sulfate, nitrate, hydroxide, $BF_4^-$, $PF_5^-$, carboxylate, acetate, tosylate or triflate.

7. Granules according to claim 2 that consist essentially of from 1 to 30% by weight of manganese complex of formula (1) based on the total weight of the granules.

8. Granules according to claim 1 that consist essentially of as dissolution restrainer an anionic dispersing agent, a non-ionic dispersing agent or a water-soluble organic polymer.

9. Granules according to claim 8 that consist essentially of as anionic dispersing agent a condensaton product of a naphthalenesulfonic acid with formaldehyde, a sodium salt of a polymerised organic sulfonic acid, a (mono-/di-) alkylnaphthalenesuffonate, a polyalkylated polynuclear arylsulfonate, a sodium salt of a polymerised alkylbenzenesulfonic acid, a lignosulfonate, an oxylignosulfonate or a condensation product of naphthalenesulfonic acid with a polychloromethyldiphenyl.

10. Granules according to claim 8 that consist essentially of as non-ionic dispersing agent a compound selected from the group consisting of:

1. fatty alcohols having from 8 to 22 carbon atoms,
2. addition products of from 2 to 80 mol of alkylene oxide in which some alkylene oxide units are optionally replaced by substituted epoxides, with higher unsaturated or saturated monoalcohols, fatty acids, fatty amines or fatty amides having from 8 to 22 carbon atoms, or with benzyl alcohols, phenylphenols, benzylphenols or alkylphenols in which the alkyl radicals have at least 4 carbon atoms,
3. alkylene oxide condensation products,
4. ethylene oxide/propylene oxide adducts with diamines,
5. reaction products of a fatty acid having from 8 to 22 carbon atoms with a primary or secondary amine having at least one hydroxy-lower alkyl or lower alkoxy-lower alkyl group, or alkylene oxide addition products of such hydroxyalkyl-group containing reaction products,
6. sorbitan esters or ethoxylated sorbitan esters,
7. addition products of propylene oxide with a tri- to hexa-hydric aliphatic alcohol having from 3 to 6 carbon atoms, and
8. fatty alcohol polyglycol mixed ethers.

11. Granules according to claim 8 that consist essentially of as non-ionic dispersing agent a surfactant of formula $$R_{11}—O\text{-(alkylene-O)}_n—R_{12} \quad (4)$$

wherein $R_{11}$ is $C_8$–$C_{22}$ alkyl or $C_8$–$C_{18}$alkenyl;

$R_{12}$ is hydrogen; $C_1$–$C_4$alkyl; a cycloaliphatic radical having at least 6 carbon atoms or benzyl;

"alkylene" is an alkylene radical having from 2 to 4 carbon atoms and n is a number from 1 to 60.

12. Granules according claim 8 that consist essentially of as water-soluble polymer a compound selected from the group consisting of:

polyethylene glycols, copolymers of ethylene oxide with propylene oxide, gelatin, polyacrylates, polymethacrylates, polyvinylpyrrolidones, vinylpyrrolidones, vinyl acetates, polyviylimidazoles, polyvinylpyridine N-oxides, copolymers of vinylpyrrolidone with long-chained α-olefins, copolymers of vinylpyrrolidone with vinylimidazole, poly (vinylpyrrolidoneldimethylaminoethyl methacrylates), copolymers of vinylpyrrolidone/dimethylaminopropyl methacrylamides, copolymers of vinylpyrrolidone/dimethylaminopropyl acrylamides, quaternised copolymers of vinylpyrrolidones and dimethylaminoethyl methacrylates, terpolymers of vinylcaprolactam/vinylpyrrolidon-dimethylaminoethyl methacrylates, copolymers of vinylpyrrolidone and methacrylamidopropyl-trimethylammonium chloride, terpolymers of caprolactamivinylpyrrolidonedimethylaminoethyl methacrylates, copolymers of styrene and acrylic add, polycarboxylic acids, polyacrylamides, carboxymethylcellulose, hydroxymethylcellulose, polyvinyl alcohols, optionally hydrolysed polyvinyl acetate, copolymers of ethyl acrylate with methacrylate and methacrylic acid, copolymers of maleic add with unsaturated hydrocarbons and mixed polymerisation products of the said polymers.

13. Granules according to claim 12 that consist essentially of as organic polymer carboxymethylcellulose, a polyacrylamide, a polyvinyl alcohol, a polyvinylpyrrolidone, gelatin, a hydrolysed polyvinyl acetate, a copolymer of vinylpyrrolidone and vinyl acetate, a polyacrylate, a copolymer of ethyl acrylate with methacrylate and methacrylic acid or a polymethacrylate.

14. A washing agent formulation comprising

I) from 5 to 90 of an anionic surfactant A) and/or of a non-ionic surfactant B), II) from 5 to 70% of a builder substance C), III) from 0.1 to 30% of a peroxide D) and IV) granules according to claim 1 in such an amount that the washing agent formulation comprises from 0.005 to 2% of the pure manganese complex of formula (1), the percentage figures in each case being percentages by weight based on the total weight of the washing agent.

* * * * *